US007245733B2

(12) United States Patent
Saltykov

(10) Patent No.: US 7,245,733 B2
(45) Date of Patent: Jul. 17, 2007

(54) HEARING INSTRUMENT MICROPHONE ARRANGEMENT WITH IMPROVED SENSITIVITY

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 655 days.

(21) Appl. No.: 10/356,986

(22) Filed: Feb. 3, 2003

(65) Prior Publication Data

US 2005/0157897 A1 Jul. 21, 2005

Related U.S. Application Data

(60) Provisional application No. 60/366,005, filed on Mar. 20, 2002.

(51) Int. Cl.
*H04R 25/00* (2006.01)

(52) U.S. Cl. ..... 381/322; 381/324; 381/328; 381/359

(58) Field of Classification Search ..... 381/312, 381/313, 322, 324, 328, 359, 355, 356, 357, 381/369, 396; 181/158, 166, 171
See application file for complete search history.

(56) References Cited

U.S. PATENT DOCUMENTS

| | | | | |
|---|---|---|---|---|
| 3,876,843 A | | 4/1975 | Moen | 179/107 |
| 4,073,366 A | | 2/1978 | Estes | 181/158 |
| 4,142,072 A | * | 2/1979 | Berland | 381/313 |
| 4,751,738 A | | 6/1988 | Widrow et al. | 381/68.1 |
| 5,757,933 A | | 5/1998 | Preves et al. | 381/68.1 |
| 5,878,147 A | | 3/1999 | Killion et al. | 381/313 |
| 6,075,869 A | | 6/2000 | Killion et al. | 381/313 |
| 6,101,258 A | | 8/2000 | Killion et al. | 381/321 |
| 6,134,334 A | | 10/2000 | Killion et al. | 381/356 |
| 6,151,399 A | * | 11/2000 | Killion et al. | 381/313 |
| 6,285,771 B1 | | 9/2001 | Killion et al. | 381/313 |
| 6,327,370 B1 | | 12/2001 | Killion et al. | 381/313 |

FOREIGN PATENT DOCUMENTS

WO WO 00/38477 6/2000

OTHER PUBLICATIONS

European Search Report.

* cited by examiner

*Primary Examiner*—Curtis Kuntz
*Assistant Examiner*—Tuan Doc Nguyen
(74) *Attorney, Agent, or Firm*—Alexander J. Burke

(57) ABSTRACT

The invention is directed to a hearing instrument for positioning in the ear of a user, incorporating a faceplate having first and second spatially separated sound openings for receiving sound to be provided to respective inlets of a microphone; at least one screen partially blocking the sound openings and positioned to increase effective distance between the first and second spatially separated sound openings; and a housing for containing the microphone, the housing having the faceplate mounted thereon and being sized to fit within the ear of a hearing instrument wearer.

12 Claims, 3 Drawing Sheets

HEARING INSTRUMENT MICROPHONE ARRANGEMENT WITH IMPROVED SENSITIVITY

This is a non-provisional application of provisional application Ser. No. 60/366,005 by Oleg Saltykov, filed Mar. 20, 2002.

BACKGROUND

1. Field of the Invention

The field of the invention concerns hearing instruments, and particularly hearing instruments with directional microphones.

2. Description of the Prior Art

Conventional hearing instruments typically comprise a single omni-directional microphone, which amplifies sound substantially equally from all directions. Because of the omni-directional nature of these hearing instruments, it is often difficult for the wearer to distinguish between a speaker's voice and background noise. Hearing instruments have therefore been developed that accentuate a speaker's voice over background noise.

Directional microphones may be implemented in hearing aids in several ways. In one system, two or more omni-directional elements are linked to two or more individual ports. One microphone is linked to each port, and electrical signals are processed in order to extract the directional response. Alternatively, one or more directional elements may be linked to two or more ports. One directional microphone is linked to two ports, and the signal is processed by the directional element. The difference in sound intensity on the closely-positioned ports of this type of directional hearing aids is typically negligible and the information about the direction of arriving sound signals is derived from the phase differences of the sound signals.

However, directional microphones, although suitable for isolating a speaker's voice, typically have signal-to-noise ratios less than that of omni-directional microphones. Also, directional microphones are very sensitive to wind noise. Thus, in environments with little background or high wind noise, an omni-directional microphone is more desirable for use in processing sound. Therefore, hearing instruments have been developed that include both an omni-directional and a directional microphone, wherein a wearer switches between the two modes as desired.

Unfortunately, hearing instruments that contain both an omni-directional microphone and a directional microphone typically have lower sensitivity in the directional mode and are larger in size as compared to hearing instruments containing only an omni-directional microphone. These dual mode hearing instruments generally have two separate microphone cartridges and a separate toggle switch for switching between them. The total space occupied by these components limits their use to users with ears large enough to accommodate the devices. An unfortunate result is that children often cannot make use of these larger devices.

Accordingly, the hearing instrument industry seeks reduced sized hearing instruments with improved sensitivity and simplified assembly, yet having the advantages of both omni-directional and directional functionality.

SUMMARY OF THE INVENTION

Embodiments of the invention include a hearing instrument for positioning in the ear of a user, incorporating a faceplate having first and second spatially separated sound openings for receiving sound to be provided to respective inlets of a microphone; at least one screen partially blocking the sound openings and positioned to increase effective distance between the first and second spatially separated sound openings; and a housing for containing the microphone representing the received sound, the housing having the faceplate mounted thereon, the housing being sized to fit within the ear of a hearing instrument wearer and containing the microphone.

BRIEF DESCRIPTION OF THE DRAWINGS

The invention is best understood from the following detailed description when read with the accompanying drawings.

DETAILED DESCRIPTION

The invention will be understood more fully from the detailed description given below and from the accompanying drawings of preferred embodiments of the invention; which, however, should not be taken to limit the invention to a specific embodiment but are for explanation and understanding.

A hearing instrument in accordance with a preferred embodiment of the invention includes a microphone assembly having directional and omni-directional cartridges. The hearing instrument has a faceplate with front and rear sound ports connected to inlets of the microphone cartridges. The directional cartridge is preferably assembled with the omni-directional cartridge. A gasket, preferably made of a pressure-sensitive adhesive, may be used to achieve sealing and acoustic leak prevention in the device. One or more sound port covers block portions of the front and rear sound ports to increase the effective distance between the sound ports to provide a higher sensitivity in the directional mode.

Figure 1:
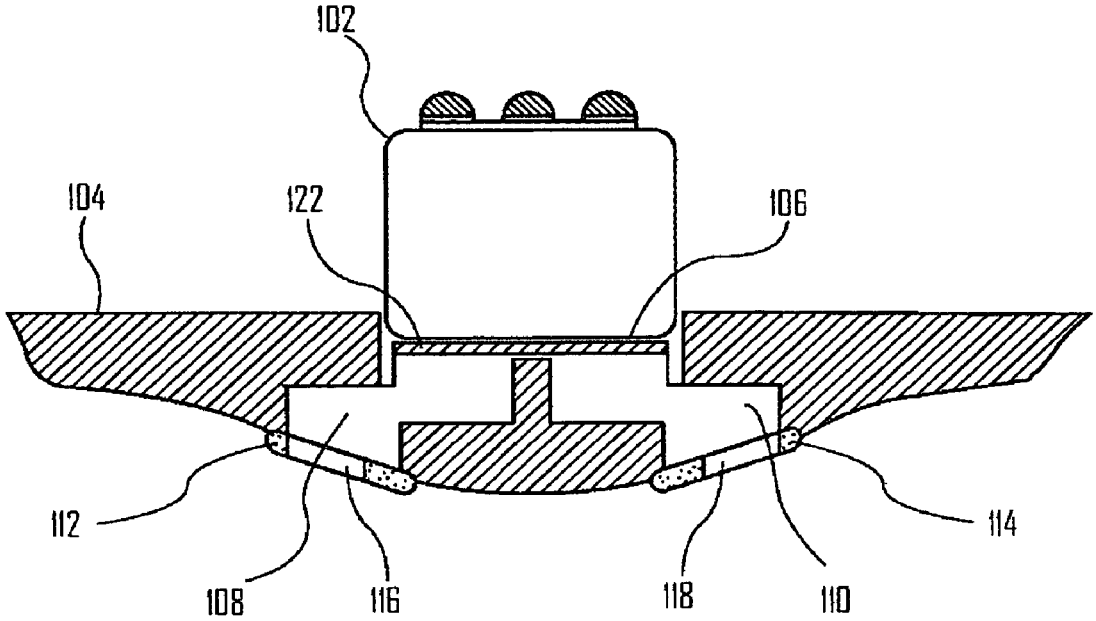
FIG. 1 is a drawing illustrating a cross-sectional view of a preferred embodiment of a microphone section of a hearing instrument.

FIG. 1 depicts a cross-sectional view of a hearing instrument device according to one preferred embodiment of the invention. A microphone assembly 102 may be at least partially embedded in a faceplate 104. In an exemplary embodiment, the microphone assembly 102 is in cartridge form. Inlets to the microphone assembly 102 may be included on a microphone assembly surface 106, as further described in connection with FIG. 2. The illustrative example depicted in FIG. 1 has surface 106 perpendicular to the plane of the page. Surface 106, however, may be any surface of the microphone assembly 102 on which the inlets may be positioned.

A front sound port 108 and a rear sound port 110 may be positioned in the faceplate 104 to allow sound to travel to the microphone assembly inlets. (The terms "front" and "rear" are used herein to facilitate understanding of the invention. The terms, however, do not limit the invention to particular relative configurations, and are merely used for illustration.) The distance between the front and rear sound ports is preferably in a range of about 5 mm to about 12 mm, although not limited thereto.

Sound port covers 112 and 114 extend across and partially block sound ports 108 and 110. The sound port covers 112 and 114 comprise openings 116 and 118, respectively, where the openings 116 and 118 are smaller than the sound ports 108 and 110, and are offset from the respective centers of the sound ports to partially obstruct the ports, therefore increasing the effective distance between the sound ports 108 and 110. The sound port covers 116 and 118 may also be used in hearing instruments employing a single-element directional microphone with a mechanical switch. Optionally, a mesh covering (not shown in the drawings) may be provided over the openings 112 and 114 to prevent unwanted particles from entering the sound ports 108 and 110. Also, the two sound port covers 112 and 114 may be realized as a monolithic construction.

Figure 2:
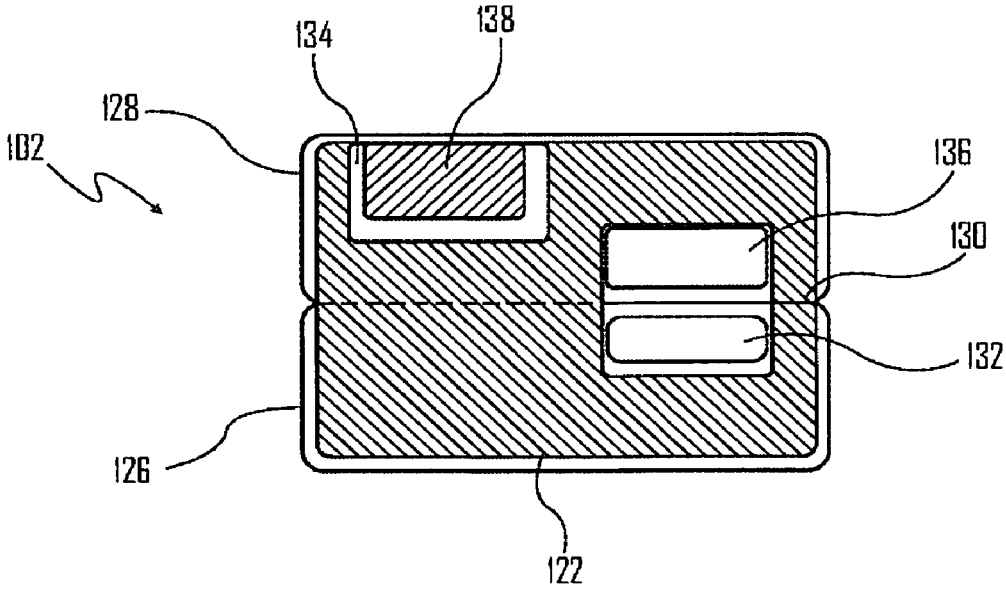
FIG. 2 is a drawing illustrating a top view of a preferred embodiment of a microphone assembly.

FIG. 2 depicts an exemplary microphone assembly that may be used in preferred embodiments of the invention. The microphone assembly 102 may include a first microphone cartridge 126, preferably located adjacent a second microphone cartridge 128 along surface 130. In a preferred embodiment, the first microphone cartridge 126 may be an omni-directional microphone cartridge, for example, and the second microphone cartridge 128 may comprise a directional cartridge. The first microphone cartridge 126 preferably includes a front, omni-directional, inlet 132 while the second microphone cartridge 128 preferably includes a rear, directional, inlet 134, and a front, directional, inlet 136. The rear inlet 134 preferably further includes an acoustic resistor 138, such as acoustic mesh, through which sound travels. The cross-sectional area of front inlet 136 is preferably in a range of about 0.05 $mm^2$ to about 2.0 $mm^2$, although not limited thereto.

The microphone assembly 102 preferably further includes a gasket 122, which may be used to seal surface 106 of the microphone assembly 102 within the hearing instrument. This helps to minimize acoustical leaks from the device. The gasket 122 preferably comprises a pressure sensitive adhesive, but is not limited thereto.

The inlets 132,134, and 136 are preferably located on the same face of the microphone assembly (e.g., surface 106). Locating them on the same face of the assembly may be advantageous, reducing device size, and improving directionality, sensitivity and signal-to-noise ratio and simplification of the assembly procedure. Sensitivity improvements resulting from the operation and configuration of the inventive hearing instrument device are estimated to be in the range of at least about 1-4 dB.

Embodiments of the invention may be used for various types of hearing instrument devices, for example, in the ear (ITE), in the canal (ITC), half shell (HS), and behind the ear (BTE) devices. Various circuit types may also be used with the inventive hearing instrument device, including, for example, analog and digital circuits.

Figure 3:
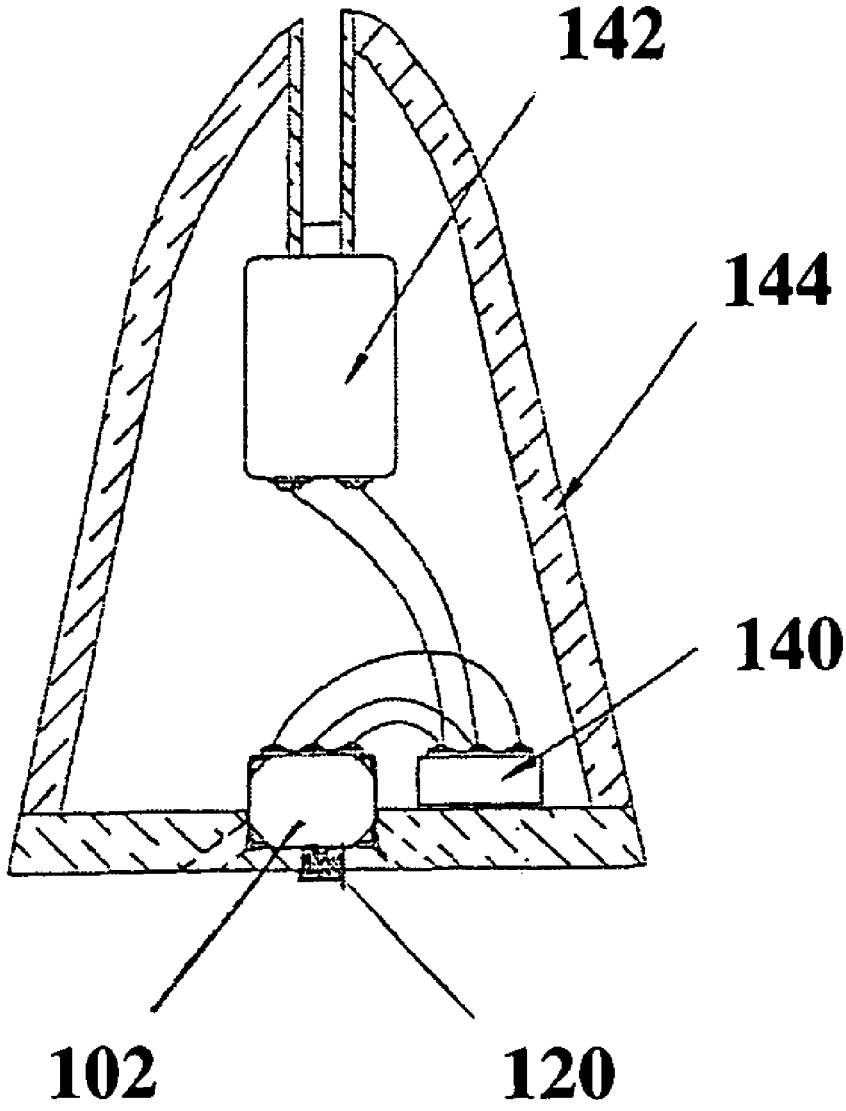
FIG. 3 is another drawing illustrating a cross-sectional view of a preferred embodiment of a hearing instrument.

FIG. 3 further depicts a hearing instrument device according to a preferred embodiment of the invention. An electric circuit 140 is operatively connected to the microphone assembly 102. The electronic circuitry processes an electrical signal from the microphone assembly representing the received sound. The microphone assembly 102 is operatively connected to an electrical switch assembly 120 through the electric circuit 140, so that the microphone assembly can be switched between the directional mode and omni-directional mode. A receiver 142 is operatively connected to the electric circuit 140 to generate an acoustical signal in the users ear based upon the received sound. A housing 144 preferably surrounds the microphone assembly 102, the electric circuit 140 and the receiver 142. The faceplate 104 may be mounted on the housing 144 to accommodate the microphone assembly 102. The housing 144 may be sized to fit within the ear of a hearing instrument user. The housing may also be configured to be compatible with ITC, HS, and BTE use.

Figure 4:
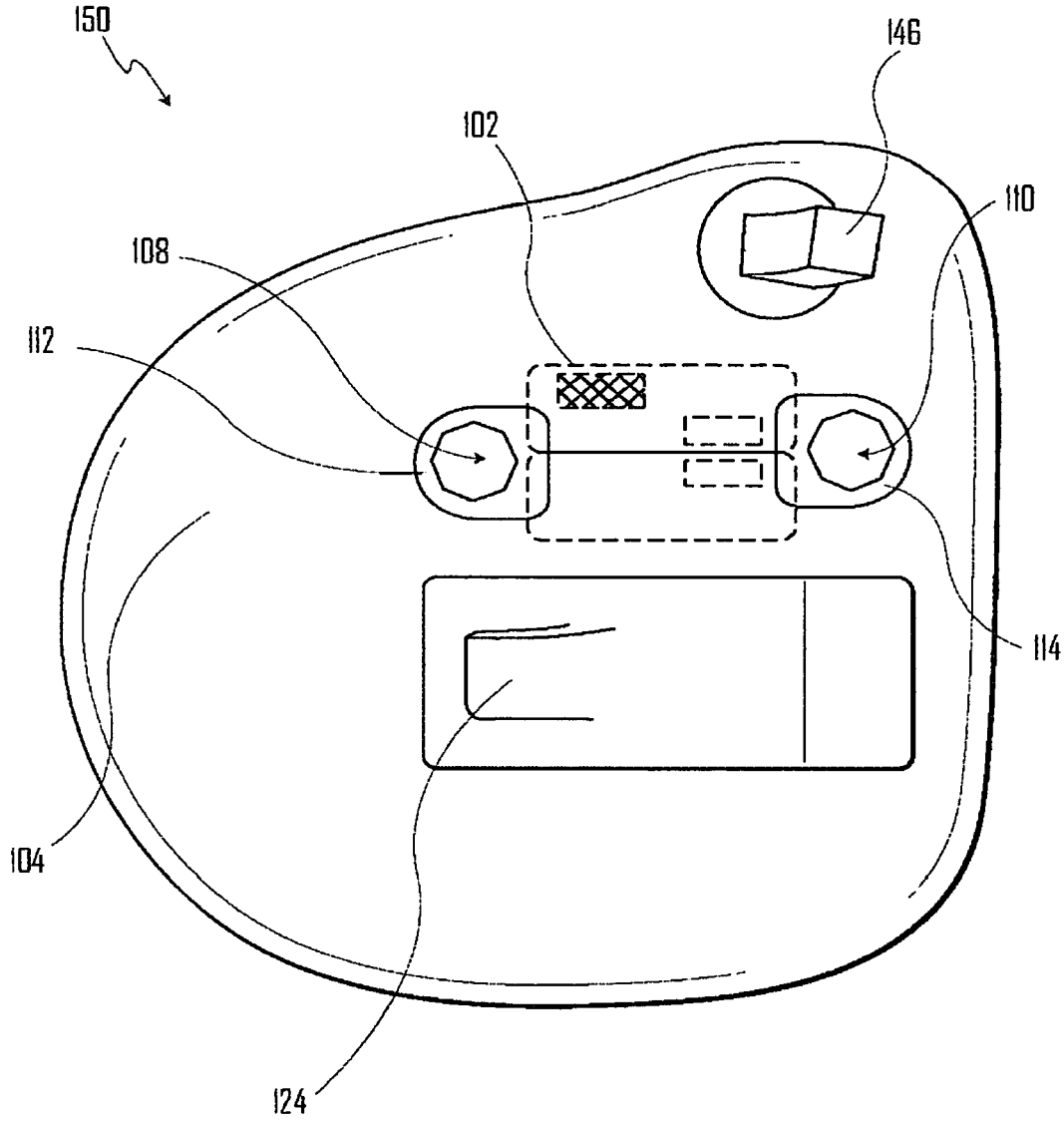
FIG. 4 is a picture illustrating a preferred embodiment of a hearing instrument.

FIG. 4 illustrates a preferred embodiment of a hearing instrument 150. The faceplate 104 is preferably rounded and cosmetically shaped for insertion into the ear. The position of the microphone assembly 102 behind the faceplate 104 is illustrated by dashed lines. The sound ports 108 and 110 are visible through the sound port covers 112 and 114, respectively. A toggle switch 124 of the switch assembly 120 is located on the outside of the faceplate 104 for access by the user. A volume control 146 may be further included to control the sensitivity of the hearing instrument. For example the volume control 146 may comprise a user adjustable potentiometer, operatively connected to the electric circuit 140 and/or the receiver 142 for control of the flow of electric current therein.

While the invention has been described by illustrative embodiments, additional advantages and modifications will occur to those skilled in the art. Therefore, the invention in its broader aspects is not limited to specific details shown and described herein. Modifications, for example, to the layout of the hearing instrument device components and their spacing, may be made without departing from the spirit and scope of the invention. Accordingly, it is intended that the invention not be limited to the specific illustrative embodiments, but be interpreted within the full spirit and scope of the appended claims and their equivalents.

What is claimed is:

1. A hearing instrument for positioning in the ear of a user comprising:

a faceplate having first and second spatially separated sound ports connected to respective inlets of a microphone;

at least one sound port cover partially blocking at least one of the first and second sound ports, the sound port cover comprising an opening offset with respect to the respective sound port; and a housing for the microphone, the housing being sized to fit within the ear of the user and having the faceplate mounted thereon.

2. A hearing instrument according to claim 1, wherein the faceplate comprises a rounded surface.

3. A hearing instrument according to claim 1, wherein the microphone comprises a plurality of microphone cartridges.

4. A hearing instrument for positioning in the ear of a user comprising:

a faceplate having first and second spatially separated sound ports connected to respective inlets of a directional microphone and an omni-directional microphone;

at least one sound port cover partially blocking at least one of the first and second sound ports, the port cover comprising an opening offset with respect to the respective sound port; and a housing for the omni-directional and directional microphones, the housing being sized to fit within the ear of the user and having the faceplate mounted thereon.

5. A hearing instrument according to claim 4, further comprising a gasket between the microphones and the faceplate, the gasket comprising openings adjacent the inlets of the microphones.

6. A hearing instrument according to claim 4, further comprising a switch for selecting between an output generated by the directional microphone and an output generated by the omni-directional microphone.

7. A hearing instrument according to claim 4, further comprising an electric circuit and receiver within the housing responsive to electrical signals from the directional microphone and the omni-directional microphone.

8. A hearing instrument according to claim 7, further comprising a volume control, where the receiver is responsive to the volume control.

9. A hearing instrument comprising:

a faceplate;

a front sound port in the faceplate;

a rear sound port in the faceplate spatially separated from the front sound port;

sound port covers partially blocking the front and rear sound ports, each of the sound port covers comprising an opening offset with respect to the respective sound port; and a microphone connected to the front and rear sound ports, the microphone comprising an omni-directional cartridge and a directional cartridge adjacent each other.

10. The hearing instrument of claim 9, further comprising a gasket between the microphone and the faceplate, the gasket comprising openings adjacent the inlets of the microphone.

11. The hearing instrument of claim 9, wherein the faceplate comprises a rounded surface.

12. The hearing instrument of claim 9, wherein the omni-directional cartridge and the directional cartridge include a plurality of inlets for receiving sound, the plurality of inlets being located on a same face of the microphone.

* * * * *